US005529625A

United States Patent [19]

Knudsen et al.

[11] Patent Number: 5,529,625

[45] Date of Patent: Jun. 25, 1996

[54] COATING APPARATUS AND GAS SEAL

[75] Inventors: Bruce A. Knudsen, Amsterdam; Mark G. Benz, Burnt Hills, both of N.Y.

[73] Assignee: General Electric Company, Schenectady, N.Y.

[21] Appl. No.: 301,921

[22] Filed: Jul. 27, 1994

Related U.S. Application Data

[63] Continuation of Ser. No. 41,095, Apr. 1, 1993, abandoned.

[51] Int. Cl.[6] ..... B05C 3/15

[52] U.S. Cl. ..... 118/65; 118/122; 118/423; 118/429; 34/242; 27/12

[58] Field of Search ..... 118/50, 423, 122, 118/65, 429; 34/242; 277/DIG. 7, 12

[56] References Cited

U.S. PATENT DOCUMENTS

| | | | |
|---|---|---|---|
| 349,531 | 9/1886 | Sherck et al. . | |
| 814,124 | 3/1906 | Fish . | |
| 2,029,985 | 2/1936 | Clark et al. . | |
| 2,834,193 | 5/1958 | Fahringer . | |
| 2,930,347 | 3/1960 | Bulloff . | |
| 4,114,563 | 9/1978 | Schnedler et al. . | |
| 5,430,955 | 7/1995 | Pietro | 34/242 |

*Primary Examiner*—John M. Hoffmann
*Attorney, Agent, or Firm*—R. Thomas Payne; William H. Pittman

[57] ABSTRACT

A coating apparatus is disclosed having a metal bath, an enclosure extending over the bath, a mandrel extending into the bath, and a gas seal mounted on the enclosure in communication with the atmosphere therein. The gas seal has a frame with a slot extending therethrough, first and second rolls aligned with the first and second ends of the slot, and a door extending between the rolls and over the seal. The door being pivotally mounted on the frame to open inwardly at the first end and outwardly at the second end.

11 Claims, 3 Drawing Sheets

COATING APPARATUS AND GAS SEAL

This application is a continuation, of application Ser. No. 08/041,095, filed Apr. 4, 1993 now abandoned.

This invention is related to a gas seal for processing an elongated body through an enclosure while minimizing air leakage into the enclosure.

BACKGROUND OF THE INVENTION

Continuous coating of a liquid onto a substrate is sometimes performed in an enclosure with a protective atmosphere to minimize oxidation or other contamination of the liquid coating material. For example, an elongate body such as a metal sheet, tape, foil, or wire can be dipped in a molten metal bath to form a coating thereon. The molten metal bath is within, or partially covered by an enclosure containing a protective atmosphere to minimize oxidation or other contamination of the molten metal bath and coating. Therefore, it is desirable to minimize air and other contaminants from leaking into the enclosure and contaminating the protective atmosphere while permitting the elongate body to pass therethrough for dipping in the molten metal bath.

An aspect of this invention is to provide a gas seal that minimizes air leakage while permitting an elongate body to pass therethrough.

BRIEF DESCRIPTION OF THE INVENTION

A hot dip coating apparatus is comprised of a vessel for containing a liquid bath, an enclosure extending over at least a portion of the bath to provide a protective atmosphere therebetween, a mandrel mounted to extend into a portion of the bath under the enclosure, and a gas seal mounted on the enclosure in communication with the atmosphere therein.

The gas seal comprises, a frame having a slot extending therethrough, the slot extending from a first end to a second end. A first roll member is mounted on the frame in alignment with the first end. A second roll member is mounted on the frame in alignment with the second end. A door extends from the first roll to the second roll and over the slot, the door being pivotally mounted on the frame to open inwardly at the first end and outwardly at the second end.

DETAILED DESCRIPTION OF THE INVENTION

The gas seal in the coating apparatus of this invention minimizes the leakage of atmosphere while permitting an elongate body such as a sheet, foil, ribbon, or wire to pass therethrough. The gas seal also guides the elongate body into and out of a coating apparatus enclosure so that the elongate body maintains its alignment with a mandrel in a liquid bath within the enclosure. At times, the elongate body passing through the coating apparatus may experience tension fluctuations or backlash that can cause the elongate body to become partly or completely displaced from the mandrel in the coating bath. The gas seal also minimizes such backlash of the elongate body within the coating apparatus to maintain the alignment of the elongate body on the mandrel. In addition, the gas seal is configured to provide a tight fitting seal while minimizing scratching, abrasion, or other damage to the elongate body passing through the seal.

Figure 1A:
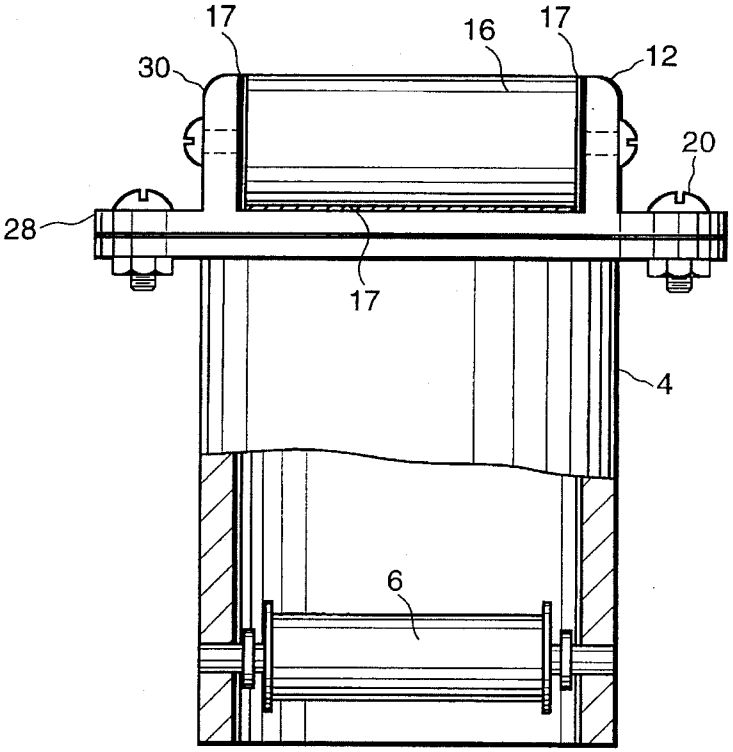
FIGS. 1 and 1*a* are side and end views of a coating apparatus having a gas seal.
Figure 1:
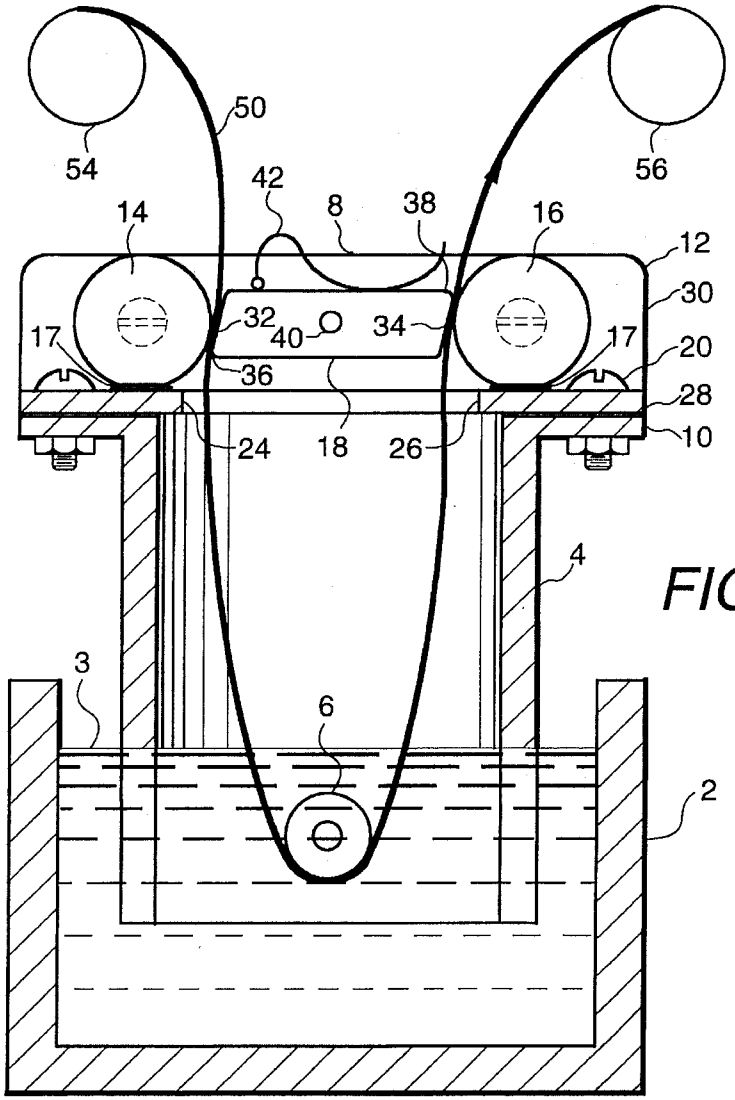

Referring to FIGS. 1 and 1*a*, the coating apparatus or sealing structure is comprised of a vessel 2 for containing a liquid bath 3, an enclosure 4, a mandrel 6, and a gas seal 8. The enclosure 4 extends over at least a portion of the bath to provide a protective atmosphere therebetween. The mandrel 6 is mounted to extend into a portion of the bath under the enclosure 4, and the gas seal 8 is mounted on the enclosure 4 in communication with the atmosphere therein.

The vessel 2 is formed of a suitable material for holding the liquid, e.g., stainless steel for containing liquid tin or tin alloys. Preferably, the enclosure 4 extends over the entire liquid bath to maintain a protective atmosphere over the liquid. Preferably, the enclosure is formed from a material resistant to the liquid when it extends into the liquid bath. For example, the enclosure 4 can be formed as tubular housing, and the mandrel 6 can be mounted between oppositely facing surfaces of the tubular housing in a portion of the housing extending into the liquid bath.

The enclosure 4 extends above the liquid bath to an upper end 10. The gas seal 8 is mounted on the upper end 10 to seal the enclosure 4. For example, the upper end 10 is formed as a flange. The gas seal 8 extends over the upper end 10 and is sealably mounted to the flange, for example, by conventional fasteners 20. The gas seal 8 is comprised of a frame 12, a first roll 14, a second roll 16, and a door 18. The frame 8 extends over the upper end 10 of the enclosure 4.

Figure 2:
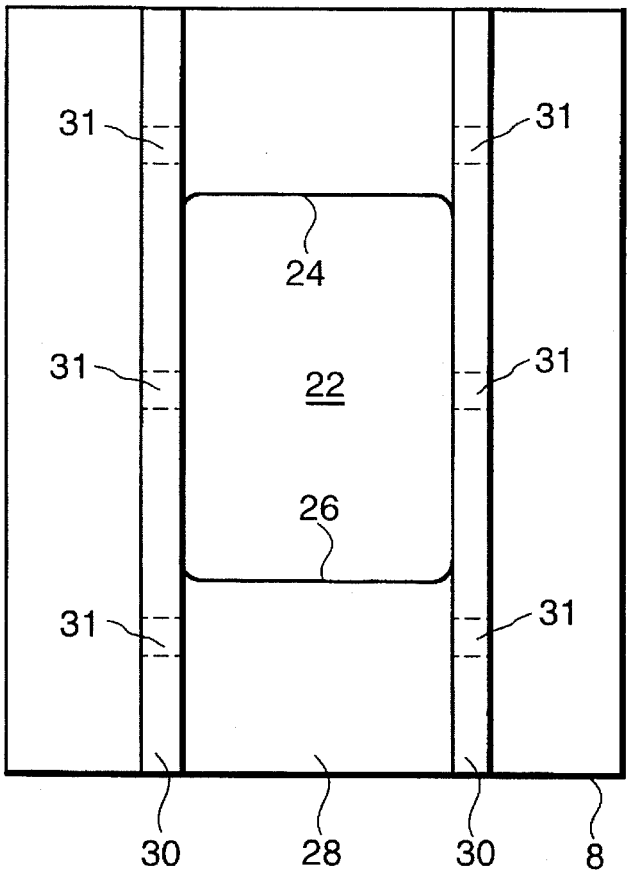
FIGS. 2 and 2*a* are top and end views of a frame for the gas seal.

Referring to FIG. 2, the frame 8 has a slot 22 extending therethrough, the slot extending from a first end 24 to a second end 26. The slot 22 is configured to accommodate the elongate body being processed through the gas seal. For example, when the elongate body is a foil or sheet the slot 22 can have a substantially rectangular shape, and the first and second ends are formed slightly larger then the width of the foil or sheet. Preferably, the slot is formed with corners having a radius to minimize damage to the elongate body passing therethrough. For example, it was found that foil passing through the slot could be wedged into corners forming a sharp 90° angle causing damage to the foil edge.

Figure 2A:
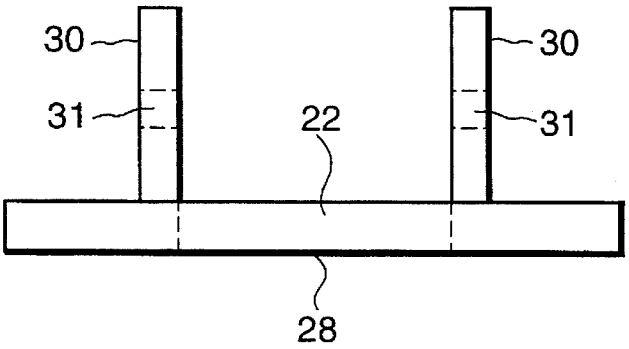

Referring back to FIGS. 1 and 1*a*, the first roll or member 14 is mounted on the frame so that the roll is substantially aligned with the first end 24. The second roll or member 16 is mounted on the frame so that the roll is substantially aligned with the second end 26. For example, the frame has a base 28 through which the slot 22 extends. Sidewalls 30 extend from the base substantially normal to the first and second ends on opposite sides of the slot 22, as shown in FIGS. 2 and 2*a*. The sidewalls 30 are formed with bores 31 extending therethrough for mounting the first and second rolls therein. The door 18 extending between the sidewalls to form the seal over the slot.

Preferably, a section of the first and second rolls extends over the slot 22 so that an elongate body 50 passing through the seal is spaced from the first and second ends 24 and 26 by the section of the rolls protruding over the slot. Preferably, the rolls are mounted to be stationary so that a gasket 17, such as silicone rubber, can be positioned between the rolls and the frame to form a seal therebetween. The rolls can be formed with a flattened surface on the outside diameter facing the base 28 with the gasket therebetween to provide the stationary mounting. The gasket can also extend between the sidewalls 30 and the roll ends facing the sidewalls.

Figure 3:
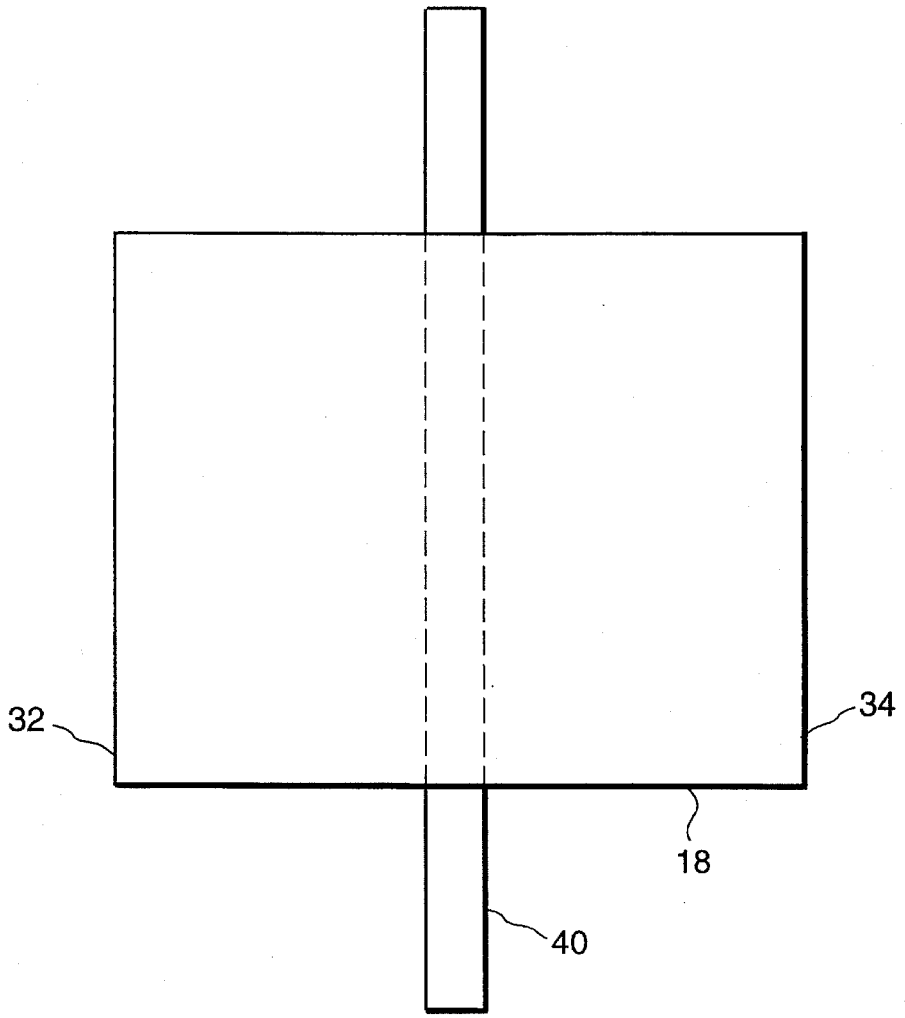
FIGS. 3 and 3*a* are top and side views of a door mounted in the frame of the gas seal or sealing structure.
Figure 3A:
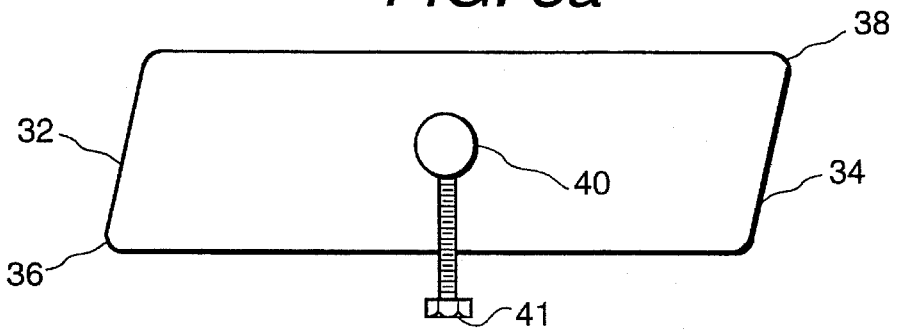

The door 18 extends from the first roll 14 to the second roll 16, and over the slot 22 so that the door forms a seal over the slot. The door 18 has a first end 32 and a second end 34, preferably, contiguous with the first and second rolls respectively. Referring to FIGS. 3 and 3*a*, the first end 32 has an end surface with a first outer edge 36, and the second door end 34 has a second end surface with a second outer edge 38 diagonal to the first outer edge 36. Preferably, the first and second surfaces are inclined so that the outer edges extend over the rolls, as shown in FIG. 1. Preferably, the outer edges 34 and 36 are rounded to minimize scratching, abrasion, or other damage to the elongate body passing between the door ends and the rolls.

Referring back to FIGS. 1 and 1*a*, the door 18 is pivotally mounted on the frame 12 so that the door opens inwardly at the first end 24, and outwardly at the second end 26. The door 18 can be formed with an axle 40 extending through the door at a mid-length position, as shown in FIGS. 3 and 3*a*. The axle 40 can be mounted in the door by a conventional fastener 41 extending through a mating bore in the door, as shown in FIG. 3*a*. The axle 40 is positioned in bores extending through the sidewall so the door is between the rolls 14 and 16, and over the slot 22. Preferably, a biasing member 42, such as a spring, is mounted on the frame 8 so that it contacts the door 18 to bias the door ends against the rolls. The biasing member or biasing structure 42 maintains contact between the door ends 32 and 34, an elongate body 50, and the rolls 14 and 16 to provide a close fitting seal therebetween, despite the continuous movement of the elongate body through the seal.

In operation, a conventional drive system, not shown, feeds the elongate body 50, such as a foil, through the coating apparatus for deposition of the liquid onto the foil to form a coating thereon. The foil extends from a payoff reel 54 through the gas seal at an inlet between the first roll 14 and the first door end 32. The door 18 pivoting inwardly at the first end 32 to permit the foil to pass therebetween. The foil passes into the liquid bath 3, around the mandrel 6, and back through the gas seal at an outlet between the second roll 16 and the second door end 34. The door 18 pivoting outwardly at the second end 34 to permit the foil to pass therefrom. The coated foil can be collected on takeup reel 56.

Preferably, the enclosure 4 extends above the liquid bath a sufficient distance to allow the coating to dry before the coating passes through the outlet in the gas seal. The biasing member 42 causes the pivotally mounted door to urge the first door end against the foil, and the foil against the first roll 14. The second door end is urged against the foil, and the foil against the second roll 16. As a result, a seal is formed between the rolls, foil, and door that minimizes exchange of atmosphere into or out of the enclosure 4. Tension reversals or backlashes in the drive system 52, causes the foil 50 to become wedged between the first and second door ends, and the rolls 14 and 16 so that tension or sufficient operative tension is maintained between the foil and the mandrel 6 within the enclosure. Therefore, the foil does not become dislodged from the mandrel during the transient tension reversal. As a result the the process does not have to be stopped for rethreading of the foil around the mandrel 6. The door 18 can move freely in the direction the drive system pulls the foil 50, so that scratching, abrasion or other damage to the foil is minimized.

What is claimed is:

1. A system for coating a substrate comprising:

an enclosure having a protective atmosphere;

a vessel containing a liquid bath;

a mandrel, operatively positioned in the enclosure such that the substrate is coated by the liquid; and sealing structure, operatively connected to the enclosure and positioned relative to the vessel for maintaining alignment of the substrate on the mandrel during movement of the substrate into the enclosure, around the mandrel and out of the enclosure, wherein the sealing structure further comprises:

a frame having a slot therein for receiving the substrate;

a first member operatively connected to the frame;

a second member operatively connected to the frame; and a door, operatively positioned in the slot between the first and second members and pivotably connected to the frame, for substantially sealing the protective atmosphere from the ambient atmosphere.

2. The system of claim 1, further comprising:

biasing structure, operatively positioned relative to the door, for urging contact between the door and the substrate, and between the two members and the substrate such that a seal is maintained despite movement of the substrate around the mandrel.

3. The system of claim 2, wherein the door is pivotable about an axis in the same direction as the substrate is moved around the mandrel.

4. The system of claim 3, wherein when tension reversals in the substrate occur, the substrate is wedged between the door and the first and second members such that operating tension is maintained in the substrate between the door and the mandrel during the coating of the substrate.

5. The system of claim 1, wherein the sealing structure maintains the substrate in operative contact with the mandrel during at least one substrate transient tension reversal.

6. The system of claim 5, wherein any need for rethreading of the mandrel is significantly reduced after at least one substrate transient tension reversal.

7. A system for coating a substrate comprising:

an enclosure having a protective atmosphere;

a vessel containing a liquid bath;

a mandrel, operatively positioned in the enclosure such that the substrate is coated by the liquid; and sealing structure, operatively connected to the enclosure and positioned relative to the vessel for maintaining alignment of the substrate on the mandrel during movement of the substrate into the enclosure, around the mandrel and out of the enclosure, the sealing structure further comprising:

a frame having a slot therein for receiving the substrate;

a first member operatively connected to the frame;

a second member operatively connected to the frame; and a door, operatively positioned in the slot between the first and second members and pivotably connected to the frame, for substantially sealing the protective atmosphere from the ambient atmosphere; and biasing structure, operatively positioned relative to the door, for urging contact between the door and the substrate, and between the two members and the substrate so that a seal is maintained despite movement of the substrate around the mandrel.

8. The system of claim 7, wherein when tension reversals in the substrate occur, the substrate is wedged between the door and the first and second members such that operating tension is maintained in the substrate between the door and the mandrel during the coating of the substrate.

9. The system of claim 7, wherein the sealing structure maintains the substrate in operative contact with the mandrel during at least one substrate transient tension reversal.

10. A system for coating a substrate comprising:

an enclosure having a protective atmosphere;

a vessel containing a liquid bath;

a mandrel, operatively positioned in the enclosure such that the substrate is coated by the liquid; and sealing structure, operatively connected to the enclosure and positioned relative to the vessel for maintaining alignment of the substrate on the mandrel during movement of the substrate into the enclosure, around the mandrel and out of the enclosure, the sealing structure further comprising:

a frame having a slot therein for receiving the substrate;

a first member operatively connected to the frame;

a second member operatively connected to the frame; and a door, operatively positioned in the slot between the first and second members, pivotably connected to the frame and pivotable about an axis in the same direction as the substrate is moved around the mandrel, for substantially sealing the protective atmosphere from the ambient atmosphere such that when tension reversals in the substrate occur, the substrate is wedged between the door and the first and second members such that operating tension is maintained in the substrate between the door and the mandrel during the coating of the substrate; and biasing structure, operatively positioned relative to the door, for urging contact between the door and the substrate, and between the two members and the substrate so that a seal is maintained despite movement of the substrate around the mandrel.

11. The system of claim 10, wherein the sealing structure maintains the substrate in operative contact with the mandrel during at least one substrate transient tension reversal.

* * * * *